United States Patent [19]

Rozmanith

[11] 4,083,137

[45] Apr. 11, 1978

[54] DISPLAY SYSTEM ADAPTED FOR PHILATELIC MATERIALS

[76] Inventor: Anthony I. Rozmanith, 1532 Berlin Rd., Cherry Hill, N.J. 08003

[21] Appl. No.: 718,033

[22] Filed: Aug. 26, 1976

[51] Int. Cl.[2] ..... G09F 1/10

[52] U.S. Cl. ..... 40/158 R; 150/41

[58] Field of Search ..... 40/158 R, 159, 135; 150/41; 206/.84, 486, 472

[56] References Cited

U.S. PATENT DOCUMENTS

| | | | |
|---|---|---|---|
| 1,956,527 | 4/1934 | Groot | 40/159 |
| 2,257,955 | 10/1941 | Herman | 40/158 R |
| 2,282,872 | 5/1942 | Mayer et al. | 40/159 |
| 2,449,204 | 9/1948 | Curtis | 40/159 |
| 2,508,854 | 5/1950 | Brodsky | 40/159 |
| 3,076,279 | 2/1963 | Afton | 40/158 R |
| 3,281,977 | 11/1966 | Koontz | 40/158 R |
| 3,333,357 | 8/1967 | Grogan | 40/158 R |
| 3,581,423 | 6/1971 | Mascolo | 40/158 R |
| 3,857,192 | 12/1974 | Mascolo | 40/158 R |

*Primary Examiner*—Samuel W. Engle
*Assistant Examiner*—Ralph Palo
*Attorney, Agent, or Firm*—Woodcock, Washburn, Kurtz & Mackiewicz

[57] ABSTRACT

A replica of a philatelic display comprising a substantially opaque base and an overlying, transparent cover. Attachment zones simulating philatelic materials are formed upon the base, while appropriate cancellation marks are simulated upon the transparent cover so that they in part overlie the attachment zones. This system presents the impression of a collage of stamps bearing related cancellation marks. The display is completed by attaching the actual stamps to the attachment zones which represent them.

16 Claims, 3 Drawing Figures

DISPLAY SYSTEM ADAPTED FOR PHILATELIC MATERIALS

BACKGROUND OF THE INVENTION

The present invention relates to display systems, and more particularly to an improved display which cooperates with, and securely encaptures, stamps and related philatelic materials.

In collecting printed materials, and particularly philatelic materials such as stamps, it is frequently desired to create a collage or grouping of related materials. For instance a number of stamps bearing a common theme or motif, such as an historical event or the like, may be grouped together. As will be appreciated by collectors, such a grouping of related collectibles is often worth far more than the sum of the values of the individual items, particularly where some of the items are relatively rare. A collage of other collectibles comprising a figure and an historically related stamp, along with an appropriate cancellation, is similarly desirable from a collector's point of view.

Collages of stamps are greatly enhanced in both aesthetic and the material value by the incorporation of appropriate cancellation marks. A Civil War commemorative stamp, for example, is greatly enhanced by a cancellation mark bearing a legend indicative of a post office or region associated with the subject matter of the stamp. A Bicentennial commemorative stamp is enhanced by a Philadelphia cancellation mark, and so on. Still further, cancellation marks having appropriate dates and special, commemorative cancellation marks further add to the value of the stamp, and accordingly to a collage in which it is incorporated.

Obtaining materials bearing interrelated stamps and cancellation marks is often difficult, particularly when a desired cancellation mark is used only a short time. Still further, the accrual of a collage of related stamps and cancellation marks is correspondingly difficult. For this reason, collages of interrelated stamps and cancellations are highly prized by collectors. Moreover, in some instances the stamps and/or cancellation marks needed to complete a given thematic collage are quite expensive, and beyond the financial range of the average collector.

Similar situations arise with respect to collections of medals, coins and other collectibles wherein it is desirable to assemble a grouping of interrelated materials, but at least some of the elements are expensive or unavailable.

For the foregoing reasons, it will be appreciated that it would be extremely desirable to provide a display system to enhance the assembling of a grouping of collectibles.

It is accordingly an object of the present invention to provide a display system which simulates a collage of collectible materials.

Another object of the invention is to provide a display system into which a collector may insert philatelic elements as available, while presenting the appearance of a completed collection.

Yet another object is to provide an improved display system wherein simulated cancellation marks are brought into close cooperation with either simulated or genuine philatelic materials.

SUMMARY OF THE INVENTION

Briefly stated, in accordance with one aspect of the invention the foregoing objects are achieved by providing a substantially opaque member having means imprinted thereon for defining attachment zones simulative of philatelic articles or the like. The attachment zones are spaced one from another, and are covered by a substantially transparent cover member overlying the base member. Means formed on the cover member define opaque areas bearing suitable indicia, and which cooperate with the underlying simulated display so as to cover, while not obscuring, the materials on the base. Stamps or the like are attached at will to appropriate, corresponding attachment zones; uncovered zones continue to give the appearance of a completed grouping or collage in an interim period until a full collection can be assembled.

In a preferred embodiment, zones simulating non-U.S. stamps are full size and in color while zones simulative of United States stamps are either formed of black and white materials, or are substantially different in size than the stamps which they represent. Zones simulating U.S. stamps in full size and in color are provided with at least one black line thereacross which serves as a "killer bar" to obviate counterfeiting practices.

BRIEF DESCRIPTION OF THE DRAWINGS

While the specification concludes with claims particularly pointing out and distinctly claiming the subject matter which is regarded as the invention, it is believed that the invention will be better understood from the following description of a preferred embodiment taken in conjunction with the accompanying drawings in which:

DESCRIPTION OF A PREFERRED EMBODIMENT

Figure 1:
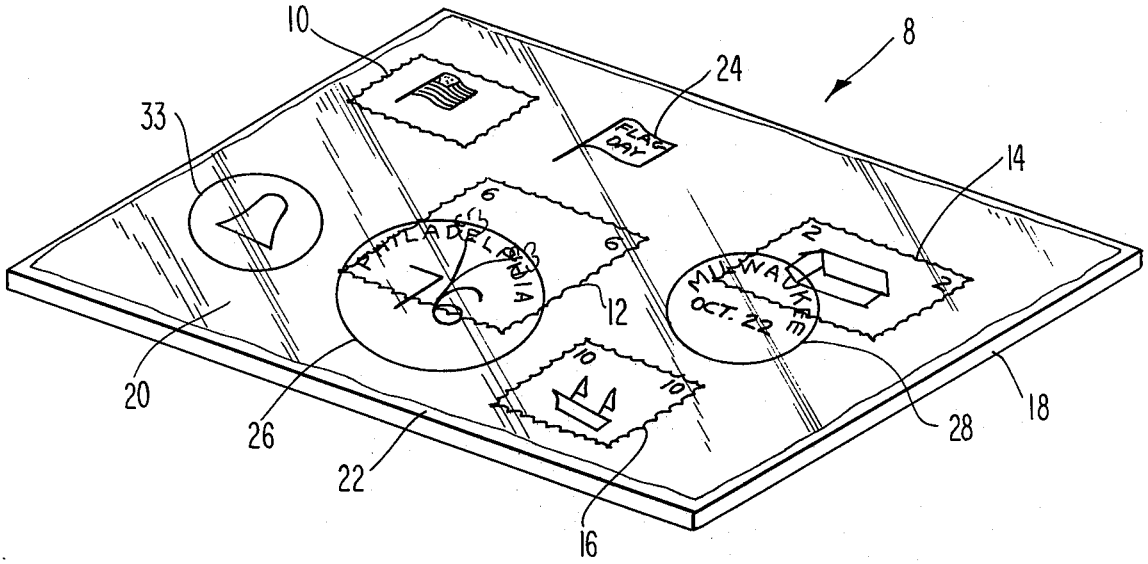
FIG. 1 is an illustration of a completed display system formed according to the present invention.

FIG. 1 depicts the present display 8 system in completed form. In the illustrated embodiment, the system is used to display a plurality of stamps 10, 12, 14 and 16. The stamps are mounted upon an opaque support or base member 18, which is advantageously of substantial thickness and rigidity although the base may be of paper or the like, in which case it may be mounted in an album or upon a suitable plaque or substrate. A transparent cover 20 overlies the support, both for protecting the collectibles interposed between it and the support, and for other reasons to be discussed hereinafter. Means such as a strip of adhesive generally indicated at 22 are provided for securing the transparent cover to the opaque base member. While adhesive material is herein contemplated, it will readily be recognized that mechanical means may alternatively be used to secure the cover. Further, in the preferred embodiment a reusable tacky adhesive may be providing so that the transparent cover may be removed and replaced for purposes which will soon become clear.

A series of opaque indicia 24, 26, 28 overlie the collectible items disposed between the transparent cover and the support or base. The indicia, while being formed of an opaque material and disposed on the transparent cover, are in a form herein designated a "line figure". By this term will be meant a configuration which, though disposed over a substantial surface area, actually blanks out a small proportion of the total surface area which it encompasses. Accordingly, the indicia 26, 28, herein depicted as typical postal cancellation marks, are formed of elements made of relatively thin lines such as an outer, bordering circle, printing and numerals. Other, similar designs may also be used it being recognized that large, solid opaque areas are to be avoided.

Indicia 24 herein represents a cachet of the type often used in conjunction with postal cancellation marks, typically to commemorate an event or to draw attention to the geographical situs of cancellation. Such indicia are ordinarily not imprinted upon a stamp when canceling stamped articles, and accordingly indicia 24 is spaced somewhat from the juxtaposed stamps.

The overall visual impression given by the display system is a collage of collectibles such as the philatelic items shown, along with appropriate, overlying and/or juxtaposed indicia such as the cancellation marks and cachet illustrated. Such items are prized by philatelists, and are commonly formed by a grouping of stamps placed upon an article which is then mailed from an appropriate location so as to obtain the benefit of a unique, aesthetically appropriate cancellation mark and/or cachet.

Inasmuch as cachets and cancellation marks change periodically, and further in view of the fact that the dates associated therewith are frequently of significance with respect to a collage of stamps and the like, it is often impossible for a collector to assemble or to reproduce a given grouping of stamps, cancellation marks and cachets. Further, oftentimes highly desirable components of a group of collectibles, such as a particular "key" stamp necessary for the completion of a grouping of stamps, is beyond the means of the average collector. By means of the present display system, however, even collages of unusual and expensive materials may be simulated at a modest cost.

Figure 2:
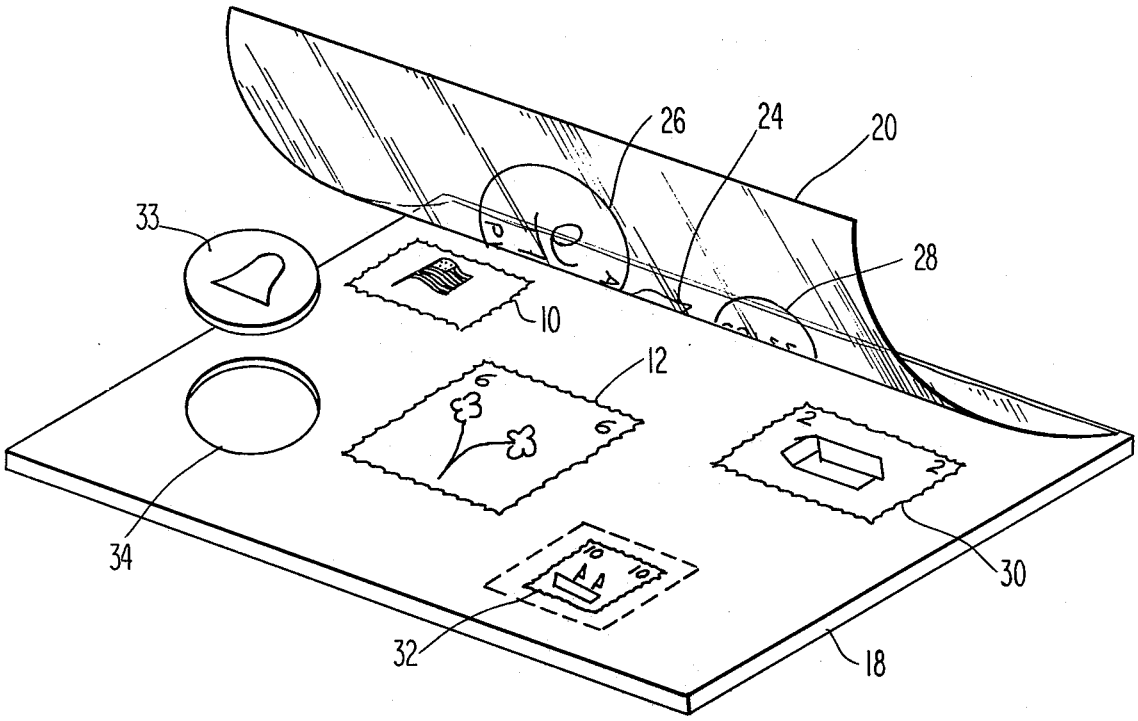
FIG. 2 illustrates the display system in partially-disassembled form.

Turning now to FIG. 2, the display system of FIG. 1 is depicted with the transparent cover 20 partially raised so as to better illustrate the construction of the system. It is now apparent that the designs comprising cancellation marks 26, 28 and cachet 24 are actually formed by opaque material disposed upon the transparent cover itself. In this manner, a mint or lightly cancelled stamp 12 can be incorporated into the collage, appearing to bear an appropriate cancellation advantageously related to the theme or subject matter of stamp 12, but without the necessity of having actually procured such cancellation. Further, cachet 24 can be juxtaposed with an appropriate stamp 10 and thus an aesthetically pleasing and highly collectible arrangement can be constructed. This system, while giving the visual impression of authenticity, allows step-by-step accumulation of the collectible items without the need for accumulation of all items in order to produce an aesthetically pleasing collage.

The latter advantage is achieved by the provision of attachment areas 30, 32 over which the actual collectible herein illustrated as a stamp, may be disposed. The attachment areas are defined by permanent printing or the like, formed by appropriate black or colored material disposed upon the opaque base member 18 in a manner which simulates the collectible to be placed thereon. In the present illustration, attachment zone 30 may be formed of colored inks or the like so as to provide a precise simulation of an appropriate stamp for the collage. Should the stamp be one which is rare and, accordingly, expensive, a collector may proceed to assemble the balance of the collage, leaving uncovered the attachment area for the more arduously-obtained collectible. In this manner the appearance of a completed collage may be attained without the expense of obtaining the more rare elements thereof.

Attachment zone 32, unlike zone 30, is substantially smaller than the collectible item 16 which is to be placed thereon. As indicated by the dotted line surrounding the area, the size of the attachment zone is significantly smaller than the collectible. This allows U.S. stamps to be simulated in color without running afoul of Federal statutes relating to the counterfeiting of U.S. stamps. Alternatively, a full-size attachment zone may be printed upon support 18 in order to represent a U.S. stamp with a black line (or killer line) extending thereacross. With yet another approach the attachment zone is full size but defined by black and white materials rather than color. This again comports with the appropriate Federal statutes relating to unauthorized duplication of postage stamps.

In one embodiment a coin, medal or the like 33 is received in a matching recess in base 18 so that its upper surface is roughly coplanar with the surrounding material. In this manner the medal comprises a part of the base assembly. While such a coin, medal or the like is conventionally made from metal it may also be of ceramic, plastic or fibrous materials.

As shown in the Figure a cavity 34 is formed in the base to receive a similarly-shaped coin or medal 33. The depth of the cavity preferably matches the thickness of the coin so that the surface of the coin lies flush with the upper surface of the base.

It will now be appreciated that the present display system lends itself well to the accumulation of other sorts of collectibles, particularly those of a relatively small, planar configuration and wherein it is desired to provide indicia overlying the collectibles which cooperate therewith, and with the support or base member, in order to form a complete display. Particularly in the field of stamp collecting overlying, cooperating indicia upon the support and on the transparent cover may be provided without the need for actually imprinting the cooperating indicia upon a common surface, or upon a collectible. Finally, the line figures used on the transparent cover serve to enhance the collectibles therebeneath, inasmuch as they do not substantially obscure either the collectible or the attachment area defining the zone for attachment of the collectible item. Such a zone may cooperatively be formed by a depression or the like in the upper surface of the base member, particularly where a collectible of appreciable thickness is to be disposed. In the latter instance, it is nonetheless desirable to form a replica or visual simulation of the collectible with the depressed area.

The transparent cover for the display system may be of any appropriate material. A flexible plastic, such as an acrylic plastic or Mylar (a proprietary term for a popular clear plastic manufactured by the E. I. du Pont de Nemours Company of Wilmington, Del.) serves admirably. Further, while as indicated above the support 18 may be made from paper, cardboard or the like it is advantageously formed of a plastic material which may be opaque, or have an opaque coating thereon. However, fabric, metal, ceramic and other materials may be substituted as appropriate for the end use which is contemplated for the display system.

Figure 3:
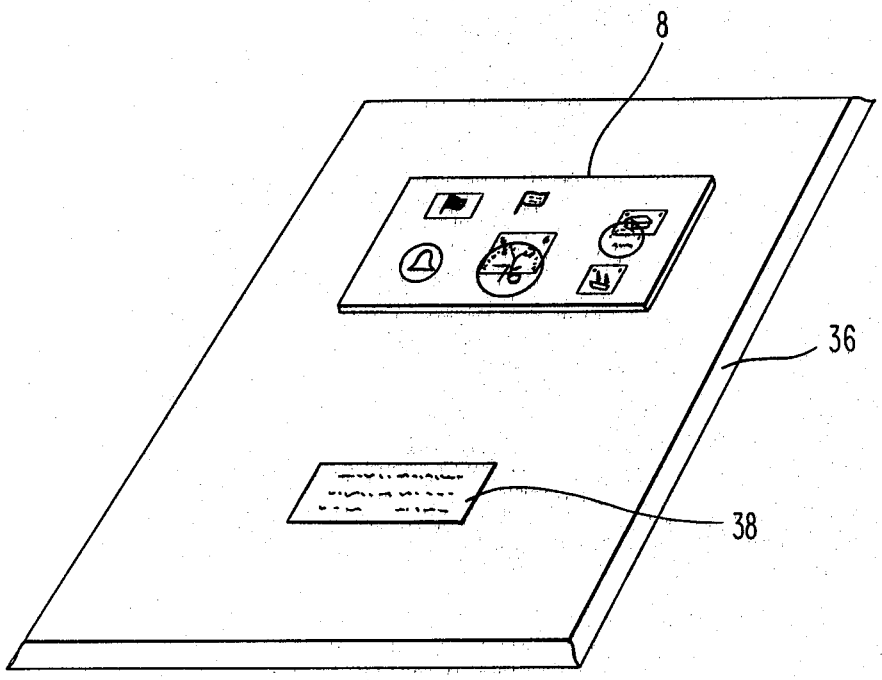
FIG. 3 shows the display in conjunction with a large plaque.

FIG. 3 illustrates the display system 8 of FIGS. 1 and 2 affixed to a main substrate or plaque 36 which bears an additional item 38. Item 38 is advantageously formed of a different material than the base member of display 8 and may for example be a commemorative metal plaque or plate whose theme complements display 8.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. An article for displaying substantially planar collectibles such as stamps, coins, and the like, comprising:

a support having attachment areas for receiving collectibles thereon;

permanent printing defining said attachment areas and simulative of a specific collectible to be attached to said support in a corresponding attachment area;

a separable, transparent cover disposed over said support and covering said attachment areas; and permanent printing formed on said transparent cover to define line figures at least partially overlying, but not obscuring, said attachment areas.

2. An article according to claim 1, further including a plurality of stamps attached directly to corresponding attachment areas simulative of the faces of the stamps.

3. An article according to claim 2, wherein certain of the attachment areas are formed by black printing and are substantially the same size as the stamps which they simulate.

4. An article according to claim 3, wherein others of the attachment areas are formed by colored printing simulative of the colors of the stamps corresponding thereto, but are substantially different in size from the stamps which they simulate.

5. An article according to claim 1, wherein said support is formed of a ceramic material.

6. A display for a plurality of individual flat printed paper collectibles, comprising:

a substantially opaque base member;

means defining attachment zones on said base member and including indicia substantially similar to indicia on said paper collectibles which visually simulate ones of said paper collectibles;

said attachment zones being spaced from one another upon said base member;

a transparent cover member overlying said base member;

means forming at least two opaque areas upon said cover member, said opaque areas at least partially overlying said attachment zones and being spaced from one another and being proportioned so that said means defining attachment zones are disposed beneath said opaque areas and remain substantially fully legible.

7. A display according to claim 6, wherein at least some of said means defining attachment zones comprise black and white indicia imprinted upon said base and are substantially identical in size to the flat paper collectibles which they simulate; and others of said attachment zones are formed by colored indicia disposed upon said base and simulate corresponding colors on ones of said paper collectibles, said last-named zones being substantially different in size from said collectibles.

8. A display according to claim 7, wherein at least some of said attachment zones comprise black and white material arranged to visually simulate a full-size United States stamp; and others of said zones comprise colored material arranged to visually simulate a full-size foreign stamp.

9. A display according to claim 8, wherein said means forming opaque areas upon said cover member approximate cancellation marks bearing information thematically related to at least some of the indicia of said attachment zones.

10. A display according to claim 6 wherein said base member is comprised of ceramic and fibrous materials.

11. A display according to claim 6 wherein said base member is comprised of metal and a fibrous material.

12. A display according to claim 6 wherein said base member is comprised of plastic and a fibrous material.

13. A display according to claim 6 wherein said base member is comprised of a ceramic and a plastic material.

14. A display according to claim 6 wherein said base member is comprised of metal and a plastic material.

15. A display according to claim 6, wherein said base member has a cavity formed in one face thereof and extending less than completely through the thickness of said base member for snugly receiving a generally planar collectible.

16. A display system comprising:

a plaque having first and second surfaces;

a display affixed to one of said surfaces of said plaque, said display being adapted to receive a plurality of individual, flat paper collectibles and including a substantially opaque base member;

means defining attachment zones on said base member and including indicia substantially similar to indicia on said paper collectibles which visually simulate ones of said paper collectibles; said attachment zones being spaced from one another upon said base member; a transparent cover overlying said base member; and means forming at least two opaque areas upon said cover member, said opaque areas being spaced from one another and being proportional so that said means defining attachment zones are substantially fully legible when disposed beneath said opaque areas; and a planar, opaque member positioned adjacent said display upon said plaque and including identifying indicia formed thereon.

* * * * *